United States Patent [19]

Yasuda et al.

[11] Patent Number: 4,806,992

[45] Date of Patent: Feb. 21, 1989

[54] DEVELOPING APPARATUS

[75] Inventors: Sachiko Yasuda; Minoru Yoshida, both of Tokyo; Tomoyuki Asada; Hideo Mukai, both of Yokohama, all of Japan

[73] Assignee: Kabushiki Kaisha Toshiba, Kawasaki, Japan

[21] Appl. No.: 18,208

[22] Filed: Feb. 24, 1987

[30] Foreign Application Priority Data

Aug. 22, 1986 [JP] Japan ..... 61-196606

[51] Int. Cl.[4] ..... G03G 15/08

[52] U.S. Cl. ..... 355/3 DD; 355/14 D; 118/651

[58] Field of Search ..... 355/3 DD, 14 D; 118/651, 652

[56] References Cited

U.S. PATENT DOCUMENTS

| | | | |
|---|---|---|---|
| 4,083,326 | 4/1978 | Kroll et al. | 118/661 |
| 4,227,796 | 10/1980 | Kamp et al. | 355/3 DD |
| 4,263,391 | 4/1981 | Saito et al. | 118/652 X |
| 4,521,098 | 6/1985 | Hosoya et al. | 355/3 |

FOREIGN PATENT DOCUMENTS

| | | | |
|---|---|---|---|
| 205178 | 12/1986 | European Pat. Off. . | |
| 56-40861 | 4/1981 | Japan . | |
| 56-91261 | 7/1981 | Japan | 355/14 D |
| 59-220763 | 12/1984 | Japan . | |
| 60-229058 | 11/1985 | Japan | 355/3 DD |
| 60-229056 | 11/1985 | Japan | 355/3 DD |
| 61-45255 | 3/1986 | Japan | 355/3 DD |
| 61-52663 | 3/1986 | Japan . | |
| 61-176961 | 8/1986 | Japan | 355/3 DD |
| 2070981 | 12/1980 | United Kingdom . | |
| 2163371A | 2/1986 | United Kingdom | 355/3 DD |

OTHER PUBLICATIONS

Patent Abstracts of Japan, vol. 5, No. 96 (P-67) (768), Jun. 23, 1981.

Patent Abstracts of Japan, vol. 10, No. 212 (P-480) (2268), Jul. 24, 1986.

Patent Abstracts of Japan, vol. 9, No. 93 (P-351) (1816), Apr. 23, 1985.

*Primary Examiner*—A. C. Prescott

*Assistant Examiner*—Jane Lau

*Attorney, Agent, or Firm*—Foley & Lardner, Schwartz, Jeffery, Schwaab, Mack, Blumenthal & Evans

[57] ABSTRACT

In a developing apparatus for developing an electrostatic-latent image by applying a charged developer to the electrostatic-latent image formed on a surface of an image carrier, a housing which stores the developer has a developing roller for feeding the developer therefrom to a developing position. A developer supply roller for supplying a triboelectrically charged developer is in rolling contact with the developer roller. The developer supply roller has a conductive material, and is rotated while electrostatically holding a developer so as to charge it by friction.

5 Claims, 3 Drawing Sheets

DEVELOPING APPARATUS

BACKGROUND OF THE INVENTION

The present invention relates to a developing apparatus for applying a developer onto a latent image formed on an image carrier to develop the latent image.

One-component developers or two-component developers are used in developing apparatuses of this type. A two-component developer includes a toner contributing to development and a carrier for properly charging this toner. However, in such a two-component developer, a mixing ratio of the toner to the carrier must be kept constant. In other words, the toner concentration must be kept constant. However, it is difficult to maintain a constant toner concentration. On the other hand, a one-component developer has an advantage in that the concentration control is not necessary, since only the toner for contributing to development is contained in the developer.

One-component developers are classified into magnetic and nonmagnetic developers. Magnetic developers contain magnetic materials in the nonmagnetic developer particles. When such a magnetic developer is used in a conventional apparatus, a magnet is arranged on the inside of a developer carrier for carrying the developer into the developing position and generating a magnetic field for supporting and carrying the developer. The following problems occur when the magnetic developer is used.

(1) The developer carrier becomes complicated, expensive and large since the magnet must be supported by the developer carrier.

(2) A magnetic developer containing magnetic particles is more expensive than a nonmagnetic developer.

(3) Since a magnetic developer contains magnetic particles which do not contribute to development, color reproducibility is not satisfactory. As a result, it is difficult to perform color development using a magnetic developer.

In order to solve the above problems, a developing apparatus using a nonmagnetic one-component developer is conveniently used. As a developing apparatus using a nonmagnetic one-component developer, U.S. Pat. No. 4,521,098 by Hosoya et al. is known. In the apparatus of Hosoya et al., a thin film layer of toner, as a nonmagnetic one-component developer which is formed on a developing roller, is pressed by only one blade, and the toner is triboelectrically charged by the blade. Thereafter, the toner is supplied to a photosensitive body on which a latent image is formed.

With the conventional developing apparatus as described above, since toner is triboelectrically charged only by one blade, all the toner particles cannot be sufficiently and reliably charged.

When the toner is insufficiently charged, fogging or scattering of toner particles occurs, and a clear image cannot be obtained.

When a toner image is successively transferred onto sheets, transferred images become blurred due to insufficient charging of toner.

SUMMARY OF THE INVENTION

It is an object of the present invention to provide a developing apparatus which can reliably and sufficiently charge toner for obtaining a clear image.

According to an aspect of the present invention, there is provided a developing apparatus for developing a latent image by applying a developer to the latent image formed on a surface of an image carrier at a developing position opposing said image carrier, comprising a housing for containing the developer, a developer carrier for carrying the developer from said housing to said developing position, developer supply means, urged against said developer carrier, for supplying charged developer to said developer carrier, said developer supply means having a conductive member, whereby said developer supply means moves the developer in said housing while electrostatically holding it, thereby triboelectrically charging the developer, and a blade which is urged against said developer carrier to form a developer thin layer.

According to the developing apparatus of the present invention, a developer feeder triboelectrically charges a developer while electrostatically holding it. The sufficiently charged developer is fed to a developer carrier. In the developer carrier, the thickness of the developer layer is controlled by a blade while carrying the sufficiently charged developer. The developer is further charged and is conveyed to an image carrier so as to develop a latent image.

DETAILED DESCRIPTION OF THE PREFERRED EMBODIMENT

Developing apparatuses according to preferred embodiments of the present invention will be described with reference to FIGS. 1 to 5.

Figure 1:
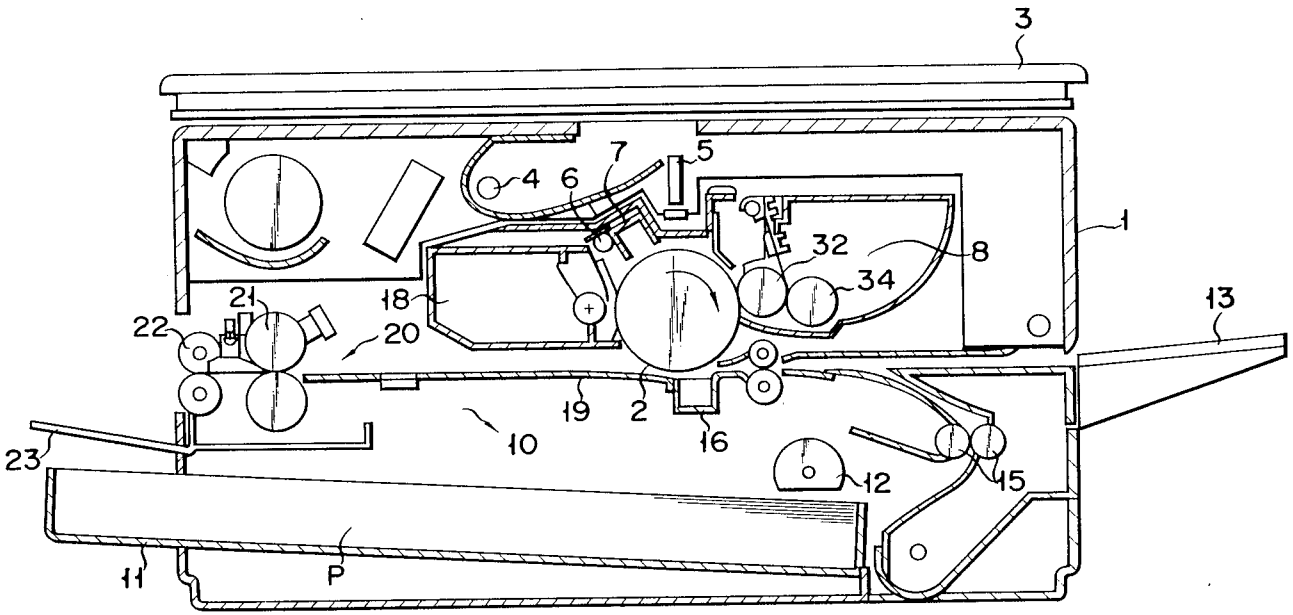
FIG. 1 is a schematic sectional view of a copying machine using a developing apparatus according to an embodiment of the present invention.

A copying machine to which the developing apparatus according to the present invention may be applied will be described. FIG. 1 is a schematic sectional view of the copying machine. Referring to FIG. 1, reference numeral 1 denotes a copying machine housing. Photosensitive drum 2, having a photosensitive film such as a selenium film thereon, is rotatably arranged at substantially the center of housing 1. An electrostatic latent image is formed on the surface of photosensitive drum 2 as an image carrier. Lamp 4 and converging optical transmission member 5, which optically scan a document placed on reciprocally driven document table 3, focus a document image on a surface portion of photosensitive drum 2 and form a latent image on the surface portion. Arranged around photosensitive drum 2 are discharge lamp 6 for discharging the surface of photosensitive drum 2 before the document image is focused thereon, charger 7 for uniformly charging the surface of photosensitive drum 2 after the surface of photosensitive drum 2 is uniformly discharged and developing apparatus 8, according to the present invention, for selectively applying the developer to the latent image formed on the surface of the photosensitive drum and for visualizing the latent image. A visible image is formed by developing apparatus 8 on photosensitive drum 2.

A paper feeding section is arranged at both sides of housing 1. The paper feeding section comprises paper cassette 11 detachably mounted at one side of the copying machine, and paper feeding rollers 12, brought into rolling contact with uppermost sheet P so as to feed this sheet P to the inside of housing 1. Manual feeding guide 13, for manually guiding a sheet, is arranged at the other side of the copying machine. The sheet fed from the paper feeding section is registered by register rollers 15 and is fed to a transfer portion of photosensitive drum 2 while the sheet is brought into slidable contact with the transfer portion.

Transfer charger 16 for transferring the visible or toner image onto sheet P is arranged around photosensitive drum 2. The transfer portion described above is defined between photosensitive drum 2 and transfer charger 16. The sheet having the toner image (visible image) thereon is guided by conveyor belt 19 to fixing unit 20. The developer on the sheet is fixed by pressure and heated by a pair of heat rollers 21 constituting fixing unit 20. The sheet having the fixed image is discharged by a pair of discharge rollers 22 onto tray 23. The residual toner remaining on the surface of photosensitive drum 2 after the transfer operation can be removed by cleaning unit 18.

In this case, in conditions for forming images, the surface potential of photosensitive drum 2 is 600 V, a gap between photosensitive drum 2 and developing roller 32 is 250 μm, and a developing bias is a superimposed voltage of AC voltage P-P of 2.0 kV at a frequency of about 3 kHz and a DC voltage of 200 V.

Figure 2:
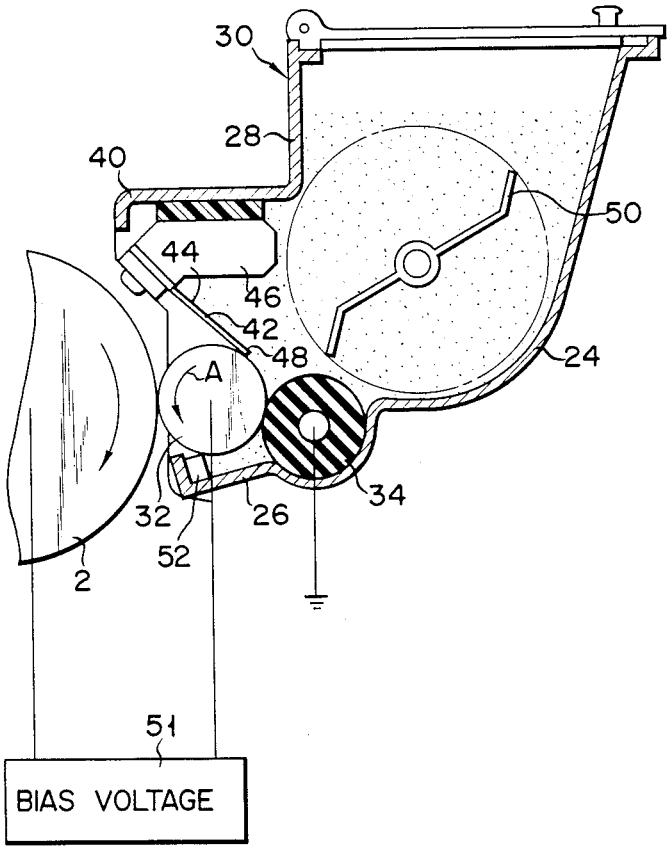
FIG. 2 is a schematic sectional view of the developing apparatus shown in FIG. 1.

Developing apparatus 8 will now be described with reference to FIG. 2. Developing apparatus 8 comprises housing 30 constituted by back frame 24, bottom frame 6, and front frame 28. Housing 30 stores nonmagnetic developer T. In housing 30, developing roller 32, for conveying the developer in housing 30 toward photosensitive drum 2 on which a latent image is formed, is interposed between bottom frame 26 and front frame 8. Developing roller 32 is arranged adjacent to photosensitive drum 2, and is rotatable in a direction indicated by arrow A in FIG. 2 in synchronism with rotation of drum 2. Therefore, a portion of developing roller 32 is located inside housing 30 to be in contact with developer T, and the other portion on the side of drum 2 is exposed to the outside between bottom frame 26 and front frame 28.

Developing roller 32 has an aluminum sleeve. The outer surface of the sleeve is subjected to sandblasting, and a nickel electroless-plating layer is formed thereon. A surface roughness after plating is about 1 μm.

Developer supply roller 34 for supplying developer T to developing roller 32 while charging developer T is arranged adjacent to bottom frame 26 in housing 30. Roller 34 is in rolling contact with roller 32.

Figure 3:
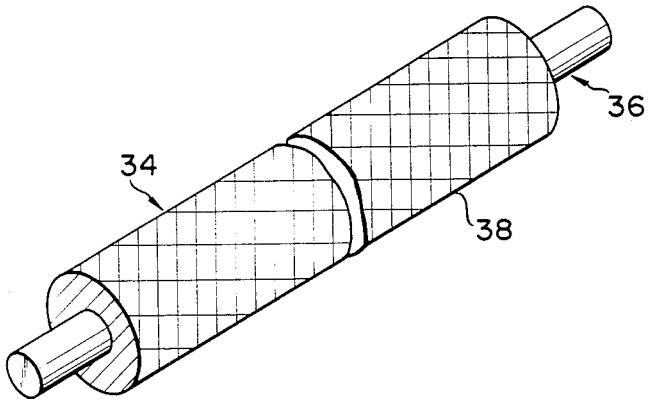
FIG. 3 is a perspective view of a supply roller shown in FIG. 2.

Developer supplying roller 34 is constituted by metal shaft 36, and conductive rubber 38 coated on shaft 36, as shown in FIG. 3. As the conductive rubber material, a material prepared by mixing carbon or metal powder in neoprene rubber is used. In this case, conductive urethane can be used in place of the conductive rubber material. Note that shaft 36 is grounded.

Proximal end portion 44 of elastic blade 42 for forming a thin film layer of developer on developing roller 32 and charging it is mounted on lower end portion 40 of front frame 28 through member 46. Free end portion 48 of elastic blade 42 is urged against developing roller 32 above a contacting point between rollers 34 and 32.

Stirring blade 50 for stirring the developer inside housing 30 is arranged at substantially the center of housing 30.

Recovery blade 52, is arranged on bottom frame 26 to abut against developing roller 32.

Developing bias power source 51 is connected to developing roller 32 and photosensitive drum 2.

The operation of this embodiment will now be described with reference to FIG. 2. In this case, a nonmagnetic developer (toner) which has a positive charging property is used.

Developer supply roller 34 is rotated in a direction opposite to arrow A at a contacting point with developing roller 32. Roller 34 moves toner therearound by a frictional force on its outer peripheral surface, so as to triboelectrically charge the toner particles. In this case, the toner is charged to be positive (+). Roller 34 is grounded, and has a negative (−) charge. Therefore, the toner becomes attached to roller 34 by an electrostatic force, and is moved upon rotation of roller 34. Therefore, since the attached toner particles are moved relatively actively upon rotation of roller 34, they can be sufficiently triboelectrically charged together with the surrounding toner particles.

The toner particles which become attached to roller 34 and are sufficiently charged are rubbed onto roller 32 at the contacting point between rollers 34 and 32. Upon this rubbing, the toner becomes attached to roller 32.

The toner attached to roller 32 is urged by blade 42 to be further triboelectrically charged, thus forming a uniform thin layer.

Roller 32 is rotated in the direction indicated by arrow A and conveys the toner layer to a position facing photosensitive drum 2. A bias is applied to roller 32 and drum 2 from power source 51, so that the toner particles attached to roller 32 fly to drum 2, thus developing a latent image formed thereon.

The residual toner which is not subjected to development remains on the outer peripheral surface of roller 32. However, the residual toner is further conveyed upon rotation of roller 32, and is recovered in housing 30 via recovery blade 52.

Since roller 32 is urged against roller 34, the residual toner on roller 32 is removed by roller 34.

Sufficiently charged toner from roller 34 is rubbed and becomes attached to developing roller 32 from which the toner has been removed.

The toner removed from roller 32 becomes attached to roller 34, and is triboelectrically charged again.

With this embodiment, after the toner is sufficiently charged by the developer supply roller, it is supplied to the developing roller. Therefore, a sufficiently charged developer can be supplied to the photosensitive drum.

The developer supply roller is formed of a conductive material, and triboelectrically charges the toner while electrostatically holding it. Thus, the toner can be reliably and sufficiently charged.

Since new toner becomes attached to the developing roller after the residual toner is removed from the developing roller, sufficiently charged toner can always be supplied to the photosensitive drum.

Figure 4:
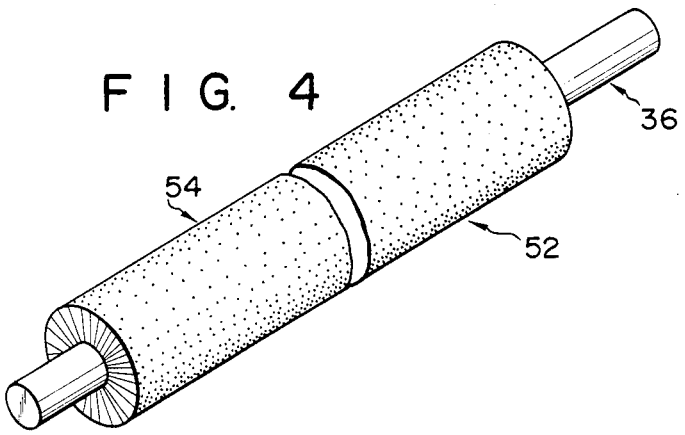
FIG. 4 is a perspective view showing a modification of the supply roller.
Figure 5:
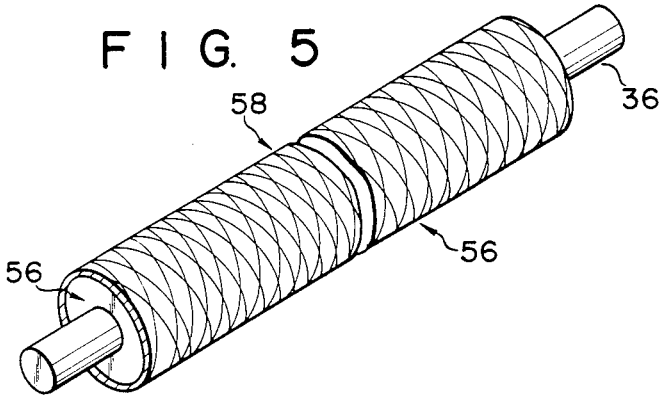
FIG. 5 is a perspective view showing another modification of the supply roller.

FIGS. 4 and 5 show a modification of developer supply roller 34 used in this embodiment.

Developer supply roller 52 shown in FIG. 4 has shaft 36 around which metal fiber 54, as a conductive fiber, is wound. Metal fiber 54 need only be a conductive fiber, and need not be a metal. For example, a conductive fiber prepared by mixing a resin such as rayon, nylon, acrylic resin, or the like with conductive carbon, metal, or the like can be used.

Developer supply roller 56 shown in FIG. 6 has shaft 36 around which foamed urethane 56 is coated, and endless metallic net 58 is adhered thereon. In this case, shaft 36 and net 58 can be partially connected to each other.

The present invention is not limited to the above embodiment, and various other changes and modifications may be made within the spirit and scope of the invention.

For example, the developer supply roller need not always be grounded. Alternatively, a voltage can be applied to the roller. In this case, negatively charged toner is used.

A plurality of developer supply rollers can be in rolling contact with the developing roller, thus again providing the same effects as above. A developer supply member is not limited to a roller but can be an endless conveyor belt.

What is claimed is:

1. A developing apparatus for developing a latent image by applying a developer to the latent image formed on a surface of an image carrier at a developing position opposing said image carrier, comprising:

a housing for containing a developer;

a developer carrier for carrying the developer from said housing to a developing position, said developer carrier having a surface which is roughened to a predetermined surface roughness;

developer supply means, positioned on one side of said developer carrier and urged against said developer carrier, for supplying charged developer to said developer carrier, said developer supply means having a metal shaft and a conductive rubber material coated on the metal shaft, said rubber material comprising powder or carbon powder mixed with rubber, whereby said developer supply means moves the developer in said housing while electrostatically holding it, thereby triboeletrically charging the developer;

means for grounding said developer supply means through said metal shaft; and a blade which is urged against said developer carrier in a region adjacent an upper portion of said developer carrier to form a thin layer of developer on said developer carrier.

2. An apparatus according to claim 1, wherein said developer is a nonmagnetic one-component toner.

3. An apparatus according to claim 1, wherein said developer supply means comprises a roller which carries the developer on an outer peripheral surface thereof to convey it.

4. An apparatus according to claim 2, wherein a sliding contact surface is formed on an outer peripheral surface of said developer supply means and removes the developer remaining on said developer carrier thereby.

5. An apparatus as recited in claim 1, further comprising stirring means, arranged above said developer supply means in said housing, for stirring the developer inside said housing.

* * * * *